US007201499B2

(12) United States Patent
Komatsu

(10) Patent No.: US 7,201,499 B2
(45) Date of Patent: Apr. 10, 2007

(54) VEHICLE LAMP UNIT

(75) Inventor: Motohiro Komatsu, Shizuoka (JP)

(73) Assignee: Koito Manfacturing Co., Ltd., Tokyo (JP)

( * ) Notice: Subject to any disclaimer, the term of this patent is extended or adjusted under 35 U.S.C. 154(b) by 41 days.

(21) Appl. No.: 11/075,889

(22) Filed: Mar. 10, 2005

(65) Prior Publication Data

US 2005/0201114 A1 Sep. 15, 2005

(30) Foreign Application Priority Data

Mar. 11, 2004 (JP) ..... P. 2004-069766

(51) Int. Cl.
*F21V 7/08* (2006.01)

(52) U.S. Cl. ..... 362/346; 362/517; 362/297; 362/304; 362/305

(58) Field of Classification Search ..... 362/516, 362/728, 347, 327–329, 297, 307, 311, 538, 362/335, 517, 304, 305, 346; 359/726–736
See application file for complete search history.

(56) References Cited

U.S. PATENT DOCUMENTS 6,181,478 B1 * 1/2001 Mandella ..... 359/642
6,644,841 B2 * 11/2003 Martineau ..... 362/545
7,021,797 B2 * 4/2006 Minano et al. ..... 362/355
2003/0218882 A1 * 11/2003 Wirth et al. ..... 362/329

FOREIGN PATENT DOCUMENTS

FR 2552528 A1 * 3/1985
JP 2002-50214 A 2/2002

* cited by examiner

*Primary Examiner*—Renee Luebke
*Assistant Examiner*—Robert May
(74) *Attorney, Agent, or Firm*—Sughrue Mion, PLLC

(57) ABSTRACT

A frontal surface of a light transmitting member disposed in such a manner as to cover a light emitting element from a front side thereof is made up of an ellipsoid of revolution which adopts an optical axis as a center axis thereof and a point on the optical axis which is near the light emitting element as a rear primary focal point thereof. A central region of the light transmitting member positioned near the optical axis is made as a light emitting surface which causes light from the light emitting element to be emitted forward. A circumferential edge region of the light transmitting member positioned outer circumferentially of the central region is made as a light reflecting surface which internally reflects light from the light emitting element so as to be directed towards a secondary focal point of the ellipsoid of revolution.

8 Claims, 9 Drawing Sheets

VEHICLE LAMP UNIT

The present application claims foreign priority based on Japanese Patent Application No. P.2004-069766, filed Mar. 11, 2004, the contents of which are incorporated herein by reference.

BACKGROUND OF THE INVENTION

The present invention relates to a vehicle lamp unit having a light emitting element such as a light emitting diode as a light source.

In recent years, vehicle lamp units comprising light emitting diodes as light sources have been broadly used.

Disclosed in JP-A-2002-050214 is a vehicle lamp unit including a light emitting diode disposed in such a manner as to be directed forward of the lamp unit and a light transmitting member disposed in such a manner as to cover the light emitting diode from a front side thereof.

The vehicle lamp unit in JP-A-2002-050214 is constructed such that light from the light emitting diode which is incident on a rear end portion of the light transmitting member is guided to a front end surface of the light transmitting member to thereby be emitted from the front end surface so as to be projected forward of the lamp unit via projection lens disposed in front of the light transmitting member.

However, the vehicle lamp unit in JP-A-2002-050214 has a problem that the illuminating direction of light emitted from the lamp unit cannot be minutely controlled.

SUMMARY OF THE INVENTION

The present invention was made in view of the situations and an object of the present invention is to provide a vehicle lamp unit using a light emitting element as a light source which can enhance a light beam utilization ratio to a light emitted from the light emitting element and can minutely control an illuminating light emitted from the lamp unit.

According to the present invention, the object is achieved, by disposing a light transmitting member covering the light emitting element from a front side thereof while devising a surface configuration of the light transmitting member and by providing a reflector.

According to embodiments of the present invention, there is provided a vehicle lamp unit comprising a light emitting element disposed near or on an optical axis which extends in a longitudinal direction of the lamp unit in such a manner as to be directed forward and a light transmitting member disposed in such a manner as to cover the light emitting element from a front side thereof, wherein a frontal surface of the light transmitting member is made up of an ellipsoid of revolution which adopts the optical axis as a center axis thereof and a point on the optical axis which is near the light emitting element as a rear primary focal point thereof, wherein a central region on the frontal surface of the light transmitting member which is positioned near the optical axis is made as a light emitting surface which causes light from the light emitting element to be emitted forward and a circumferential edge region on the frontal surface of the light transmitting member which is positioned outer circumferentially of the central region is made as a light reflecting surface which internally reflects light from the light emitting element so as to be directed towards a secondary focal point of the ellipsoid of revolution, and wherein a reflector is provided on the perimeter of the light transmitting member for reflecting light from the light emitting element which is internally reflected on the circumferential edge region and is then emitted from the central region so as to be directed forward.

The "light emitting element" means an element-like light source having a light emitting portion which emits light substantially in a form of dot, and there is no particular limitation on the type thereof. For example, a light emitting diode and laser diode can be used as the light emitting element.

There is no particular limitation on material for the "light transmitting member", as long as the material has light transmitting properties. For example, transparent resin or glass can be used for the light transmitting member.

There is no particular limitation on the position of a boundary line between the "central region" and the "circumferential edge region" on the "frontal surface" of the light transmitting member.

There is no particular limitation on the position where the "reflector" is disposed on the perimeter of the light transmitting member and the configuration of the reflecting surface of the "reflector", as long as the "reflector" is constructed so as to reflect light from the light emitting element which is internally reflected on the circumferential edge region and is then emitted from the central region on the frontal surface of the light transmitting member so as to be directed forward.

As is described in the construction that has been described above, in the vehicle lamp unit according to the embodiments of the present invention, since the light transmitting member is disposed in such a manner as to cover the light emitting element disposed near or on the optical axis which extends in the longitudinal direction of the lamp unit in such a manner as to be directed forward from the front side thereof, the light beam utilization ratio to the light from the light emitting element can be enhanced.

In this case, since the frontal surface of the light transmitting member is made up of the ellipsoid of revolution which adopts the optical axis as the center axis thereof and the point on the optical axis which is near the light emitting element as the rear primary focal point thereof, and the central region on the frontal surface of the light transmitting member which is positioned near the optical axis is made as the light emitting surface which causes light from the light emitting element to be emitted forward and the circumferential edge region on the frontal surface of the light transmitting member which is positioned outer circumferentially of the central region is made as the light reflecting surface which internally reflects light from the light emitting element so as to be directed towards the secondary focal point of the ellipsoid of revolution, and furthermore, the reflector is provided on the perimeter of the light transmitting member for reflecting light from the light emitting element which is internally reflected on the circumferential edge region and is then emitted from the central region so as to be directed forward, the following functions and advantages can be obtained.

Namely, of the light from the light emitting element which is incident on the light transmitting member, the light that has reached the central region on the frontal surface of the light transmitting member is allowed to be emitted forward from the central region. Then, as this occurs, since the surface configuration of the frontal surface is made up of the ellipsoid of revolution which adopts the optical axis as the center axis thereof and the point on the optical axis which is near the light emitting element as the rear primary focal point thereof, the emergent light from the central region constitutes substantially parallel light traveling along the optical axis, whereby a spot-like light distribution pattern is formed ahead of the lamp unit.

On the other hand, of the light from the light emitting element which is incident on the light transmitting member, the light that has reached the circumferential edge region on the frontal surface of the light transmitting member is internally reflected on the circumferential edge region towards the secondary focal point to thereby be allowed to reach the central region on the frontal surface. Then, as this occurs, since the light that has been internally reflected reaches the central region as divergent light from the secondary focal point, this emergent light from the central region which is made up of the ellipsoid of revolution constitutes divergent light which adopts a point which is positioned forward of and near to the secondary focal point on the optical axis as a substantially imaginary point source. Then, since the emergent light from the central region is reflected forward by the reflector provided on the perimeter of the light transmitting member, a light distribution pattern results which corresponds to the configuration of the reflector.

By adopting this construction, a light distribution pattern formed by light emitted from the vehicle lamp unit can be obtained as a composite light distribution pattern having a bright hot zone which is made up of the spot-like light distribution pattern formed by the light directly emitted from the central region on the frontal surface of the light transmitting member and the light distribution pattern formed by the reflected light from the reflector.

Thus, according to the invention, in the vehicle lamp unit utilizing the light emitting element as the light source, not only can the light beam utilization ratio to the light from the light emitting element be enhanced but also the light emitted from the lamp unit can be controlled with good accuracy.

In this case, in the event that the eccentricity of the ellipsoid of revolution which makes up the frontal surface of the light transmitting member is set to an inverse of a number of the refractive index of the light transmitting member, the light directly emitted from the central region can be made more accurate parallel light, whereby the spot-like light distribution pattern can be made smaller so as to make brighter the hot zone of the composite light distribution patter.

In the aforesaid construction, while there is no particular limitation on the construction of the "light emitting element" as has been described above, in the event that the light emitting element is made up of a light emitting diode comprising a light emitting chip and a resin sealing member which seals the light emitting chip and the resin sealing member is formed integrally with the light transmitting member, the construction of the lamp unit can be made simple. Here, as specific forms in which the resin sealing member is "integrally formed" with the light transmitting member, it is possible to adopt a form in which the resin sealing member is sealed in by the light transmitting member or a form in which the light transmitting member doubles as the resin sealing member by directly sealing the light emitting chip by the light transmitting member.

In addition, in the aforesaid construction, in the event that a reflecting surface of the reflector is made to have a substantially parabolic vertical sectional shape which adopts a point positioned forward of and near to the secondary focal point of the ellipsoid of revolution on the optical axis as a focal point thereof, the following function and advantage can be obtained.

Namely, as has been described above, the light from the light emitting element which is internally reflected on the circumferential edge region on the frontal surface of the light transmitting member so as to be emitted from the central region on the frontal surface constitutes the divergent light which adopts the point positioned forward of and near to the secondary focal point on the optical axis as the substantially imaginary point source. Consequently, in the event that the reflecting surface of the reflector is made up of the substantially parabolic vertical sectional shape which adopts the position of the imaginary point source as the focal point, reflected light from the reflector can be made into light which is diffused little vertically, whereby a light distribution pattern that is formed by reflected light from the reflector can be prevented from unnecessarily expanding vertically to thereby illuminate excessively a near-field region on the road surface ahead of the vehicle.

In this case, too, there is no particular limitation on the sectional shape of the reflecting surface of the reflector except for the vertical sectional shape thereof, and, for example, the reflecting surface can be made a reflecting surface of paraboloid of revolution, a reflecting surface of parabolic cylinder, or a reflecting surface of intermediate configuration between the former two configurations.

Furthermore, in the aforesaid construction, in the event that the reflector is formed in such a manner as to surround substantially only a lower half portion of the light transmitting member and substantially only an upper half portion of the circumferential edge region on the frontal surface of the light transmitting member is made as the light reflecting surface, not only can almost no upward light be emitted from the light transmitting member but also a cut-off line can be formed at an upper end edge of the light distribution pattern formed by reflected light from the reflector, whereby the vehicle lamp unit can be made suitable for forming a low beam light distribution pattern.

In this case, in the event that the light emitting element is disposed in such a manner that a lower end edge of the light emitting chip is positioned on the optical axis, the spot-like light distribution pattern formed by the light directly emitted from the central region on the frontal surface of the light transmitting member can be made a light distribution pattern in which an upper end edge thereof has a high brightness/darkness ratio along a horizontal line which passes through the optical axis, whereby the spot-like light distribution pattern can be made suitable for forming a low beam light distribution pattern which has a cut-off line at an upper end edge thereof.

DESCRIPTION OF THE PREFERRED EMBODIMENTS

Embodiments of the invention will be described below using the accompanying drawings.

Firstly, a first embodiment of the invention will be described.

Figure 1:
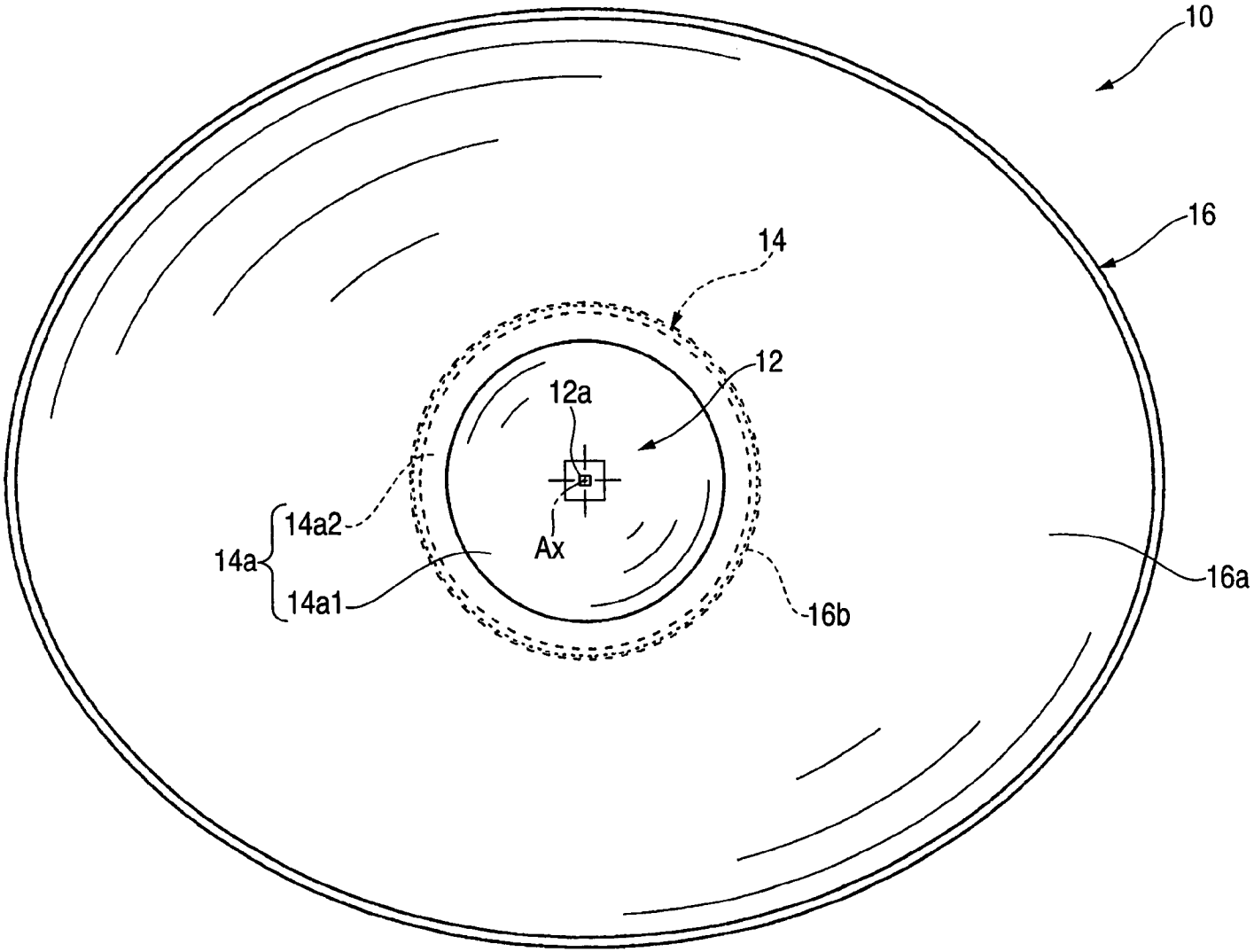
FIG. 1 is a front view showing a vehicle lamp unit according to a first embodiment of the invention.
Figure 2:
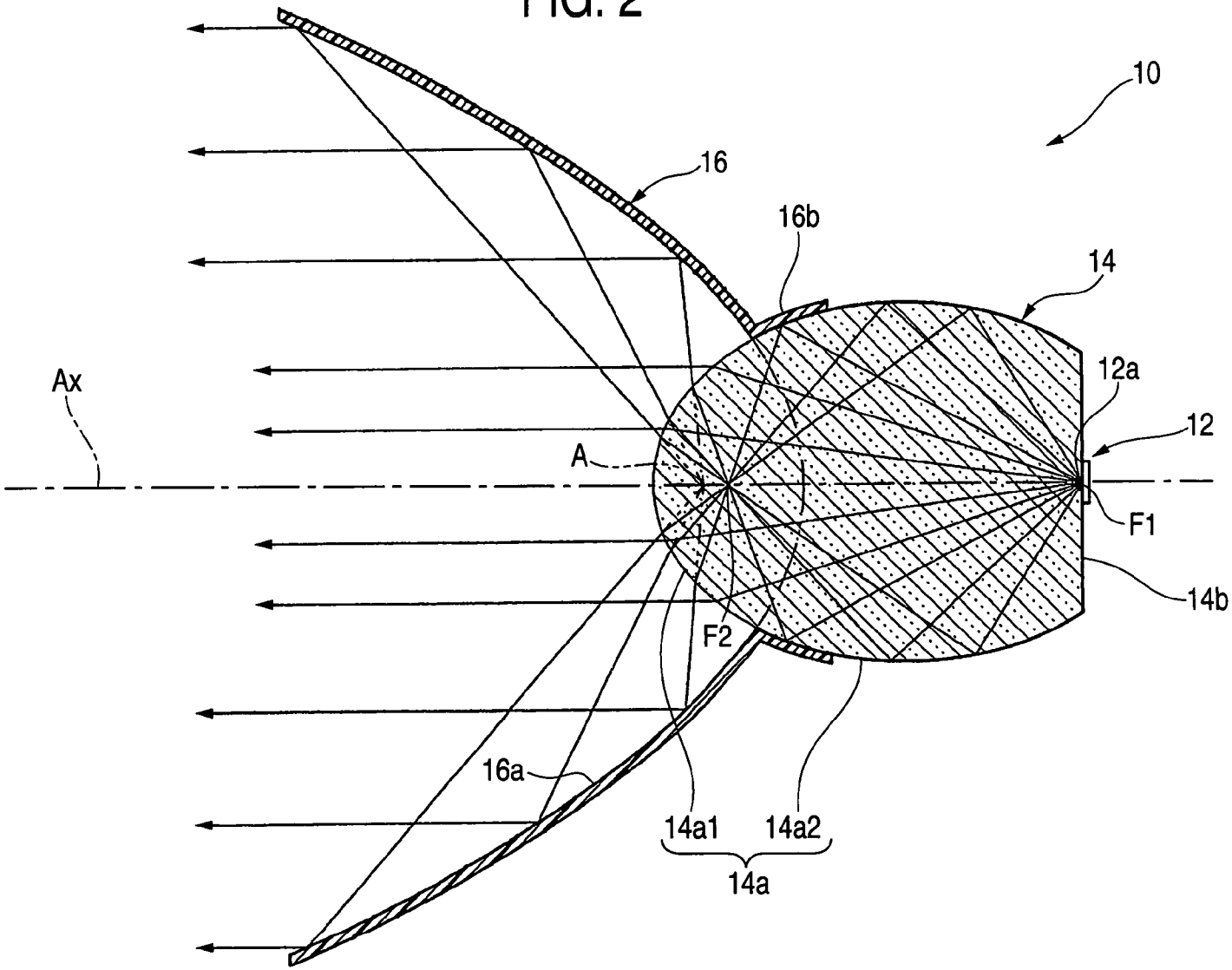
FIG. 2 is a sectional side view of the vehicle lamp unit.
Figure 3:
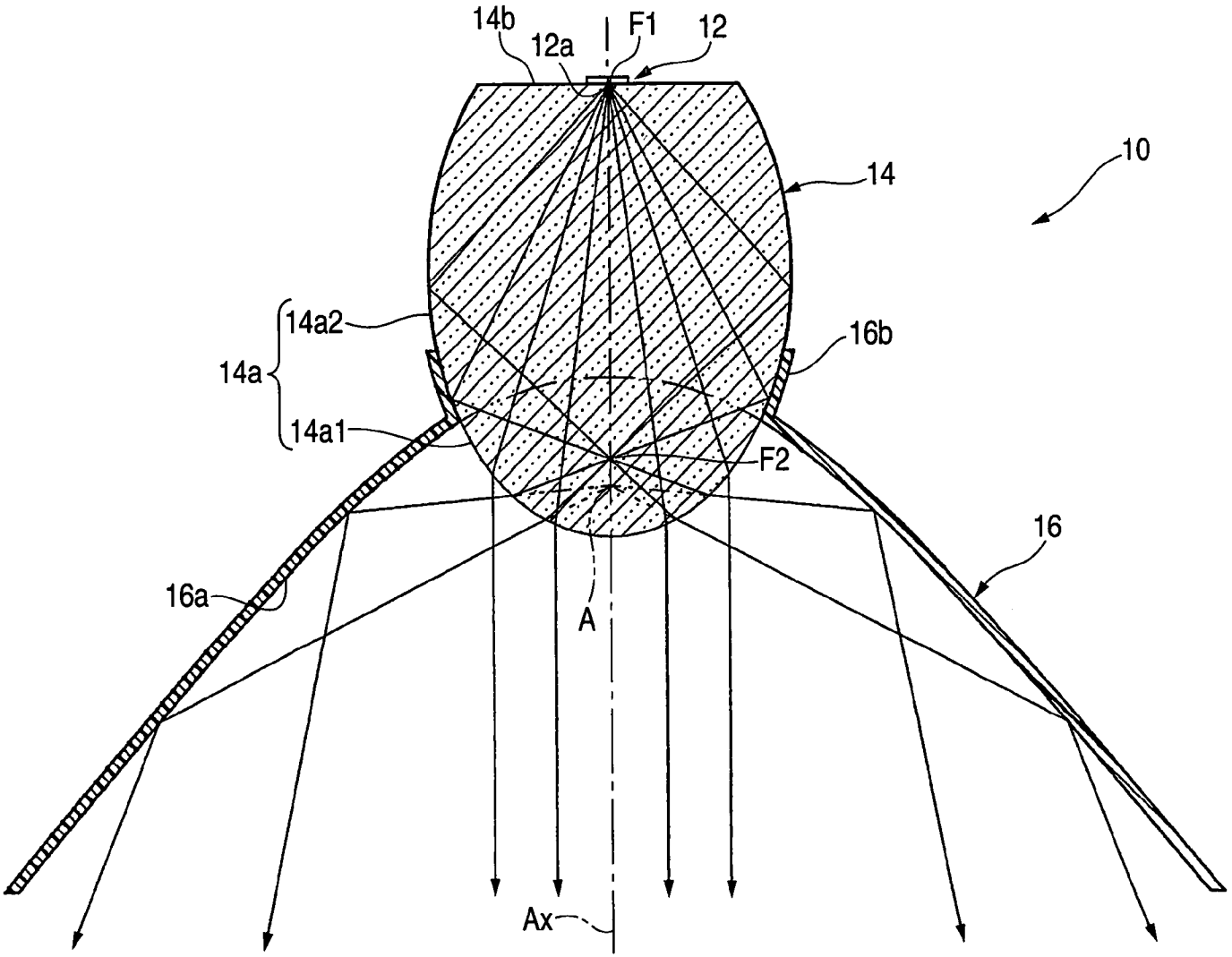
FIG. 3 is a sectional plan view of the vehicle lamp unit.

FIG. 1 is a front view showing a vehicle lamp unit 10 according to the first embodiment, and FIGS. 2 and 3 are sectional side and plan views thereof, respectively.

As is shown in these drawings, the vehicle lamp unit 10 is a headlamp, which is constructed to emit light for forming a high beam light distribution.

This vehicle lamp unit 10 includes a light emitting element 12 which is disposed on an optical axis Ax extending in a longitudinal direction of the vehicle in such a manner as to be oriented forward, a light transmitting member 14 disposed in such a manner as to cover the light emitting element 12 from a front side thereof and a reflector 16 provided on the perimeter of the light transmitting member 14.

The light emitting element 12 is a white light emitting diode having a square light emitting chip 12 having height and width of 0.3 to 3 mm and fixed to a rear end face 14*b* of the light transmitting member 14 in such a manner that a light emitting center of the light emitting chip 12*a* is positioned on the optical axis Ax. Then, by adopting this construction, the light emitting chip 12*a* of the light emitting element 12 is constructed to be sealed in directly by the light transmitting member 14.

The light transmitting member 14 is a block-like member of a transparent resin, and the rear end face 14*b* of the light transmitting member 14 is made up of a plane which intersects with the optical axis Ax at right angles, whereas a frontal surface 14*a* thereof is made up of an ellipsoid of revolution which adopts the optical axis Ax as a center axis thereof and a point where the light emitting element 12 is disposed on the optical axis Ax as a rear primary focal point F1 thereof. In this case, the eccentricity "e" of the ellipsoid of revolution which makes up the frontal surface 14*a* of the light transmitting member 14 is set to an inverse of a number of the refraction index "n" of the light transmitting member 14 (namely e=n/1).

A central region 14*a*1 that is positioned near the optical axis Ax on the frontal surface 14*a* of the light transmitting member 14 is made as a light emitting surface which allows light from the light emitting element 12 to be emitted forward. On the other hand, a circumferential edge region 14*a*2 that is positioned outer circumferentially of the central region 14*a*1 on the frontal surface 14*a* of the light transmitting member 14 is made as a light reflecting surface which internally reflects light from the light emitting element 12 towards a secondary focal point F2 of the ellipsoid of revolution. This light reflecting surface is formed by applying a specular or mirror treatment such as via aluminum deposition on the surface of the light transmitting member. In this case, a front end position of the light reflecting surface is set at a position where a plane that intersects at right angles with the optical axis Ax slightly rearward of the secondary focal point F2 intersects with the ellipsoid of revolution.

The reflector 16 is constructed to reflect forward light from the light emitting element 12 which is internally reflected on the circumferential edge region 14*a*2 on the frontal surface 14*a* of the light transmitting member 14 so as to be emitted from the central region 14*a*1. As this occurs, the reflector 16 is provided in such a manner as to surround the light transmitting member 14 around the full circumference thereof and is fixed to a front end portion of the circumferential edge region 14*a*2 on the frontal surface 14*a* of the light transmitting member 14 at a rear end flange portion 16*b*.

A reflecting surface 16*a* of the reflector 16 has a parabolic vertical sectional shape which adopts a point A which is positioned forward of and near to the secondary focal point F2 on the optical axis Ax as a focal point thereof, as well as a hyperbolic horizontal sectional shape which adopts the point A as a focal point thereof.

Figure 4:
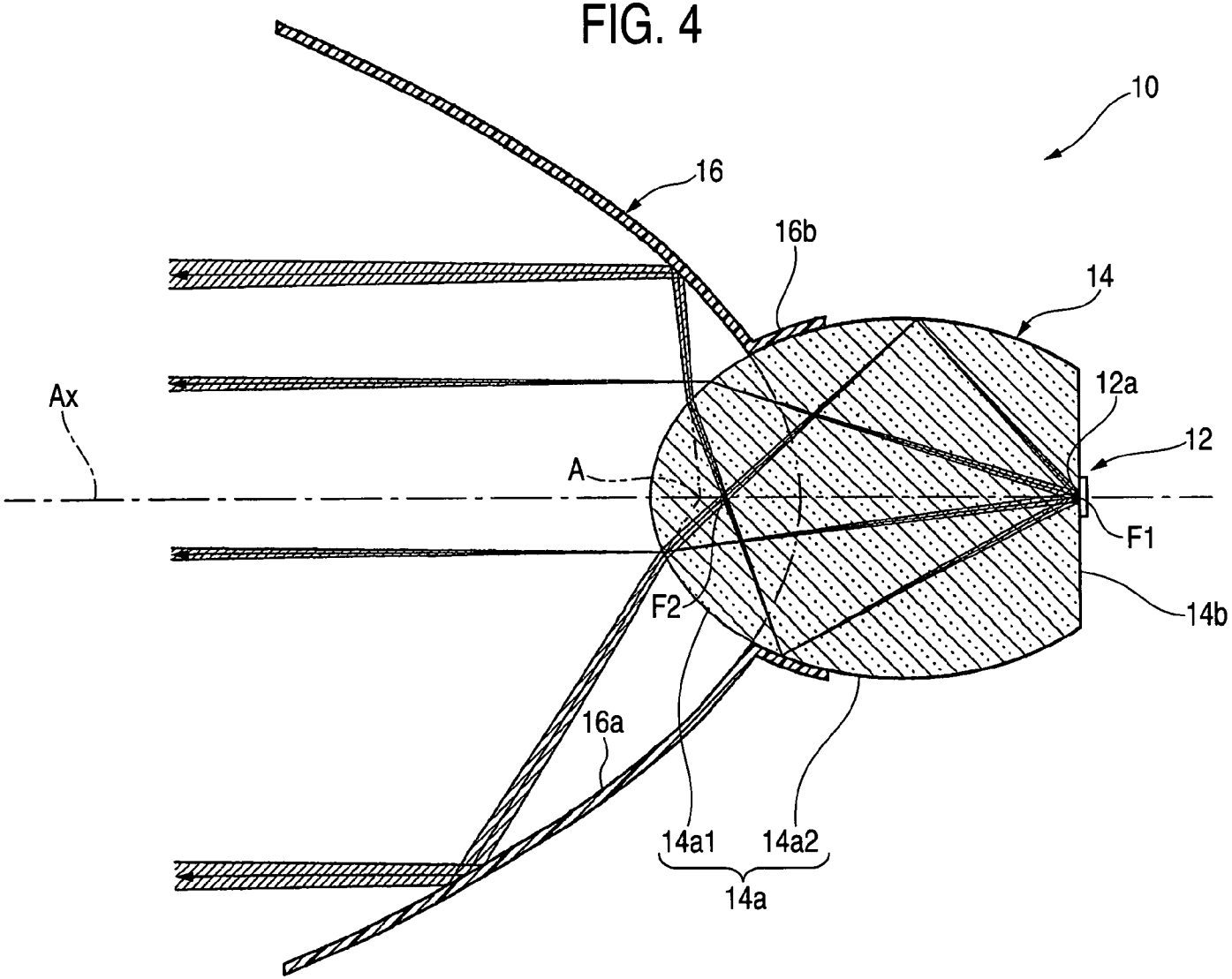
FIG. 4 is a drawing similar to FIG. 2, which illustrates optical paths of light emitted from the vehicle lamp unit by taking for example light emitted from a light emitting center of a light emitting chip of a light emitting element and upper and lower end edges thereof.

FIG. 4 is a drawing similar to FIG. 2, which illustrates optical paths of light emitted from the vehicle lamp unit 10 by taking for example light emitted from the light emitting center of the light emitting chip 12*a* of the light emitting element 12 and upper and lower end edges thereof.

As shown in the same drawing, of light emitted from the light emitting element 12, light that has reached the central region 14*a*1 of the frontal surface 14*a* of the light transmitting member 14 directly to thereby be emitted from the central region 14*a*1 (hereinafter, referred to as direct emitted light) constitutes substantially parallel light to the optical axis Ax. This is because since the light emitting element 12 is positioned on the primary focal point F1 of the ellipsoid of revolution which makes up the frontal surface 14*a* of the light emitting member 14 and the eccentricity "e" of the ellipsoid of revolution is set to the inverse of a number of the refraction index "n" of the light transmitting member 14, the direct emitted light from the light emitting center of the light emitting chip 12*a* constitutes parallel light to the optical axis Ax and light from the other locations of the light emitting chip 12 also constitutes light similar to the parallel light.

On the other hand, of the light emitted from the light emitting element 12, light that has reached the circumferential edge region 14*a*2 on the frontal surface 14*a* of the light transmitting member 14 is internally reflected on the circumferential edge region towards the secondary focal point F2 to thereby be allowed to reach the central region 14*a* on the frontal surface 14*a*. However, since the internally reflected light reaches the central region 14*a*1 as divergent light from the secondary focal point F2, light emitted from the central region 14*a*1 made up of the ellipsoid of revolution (hereinafter, referred to as "indirect emitted light") constitutes divergent light which adopts the point A positioned forward of and near to the secondary focal point F2 on the optical axis Ax as the substantially imaginary point source.

In this case, since the reflecting surface 16*a* of the reflector 16 has the parabolic vertical sectional shape and the hyperbolic horizontal sectional shape which both adopt the point A as the focal points thereof, the indirect emitted light from the light transmitting member 14 is caused to be emitted forward while being diffused horizontally with almost no vertical diffusion being allowed.

Figure 5:
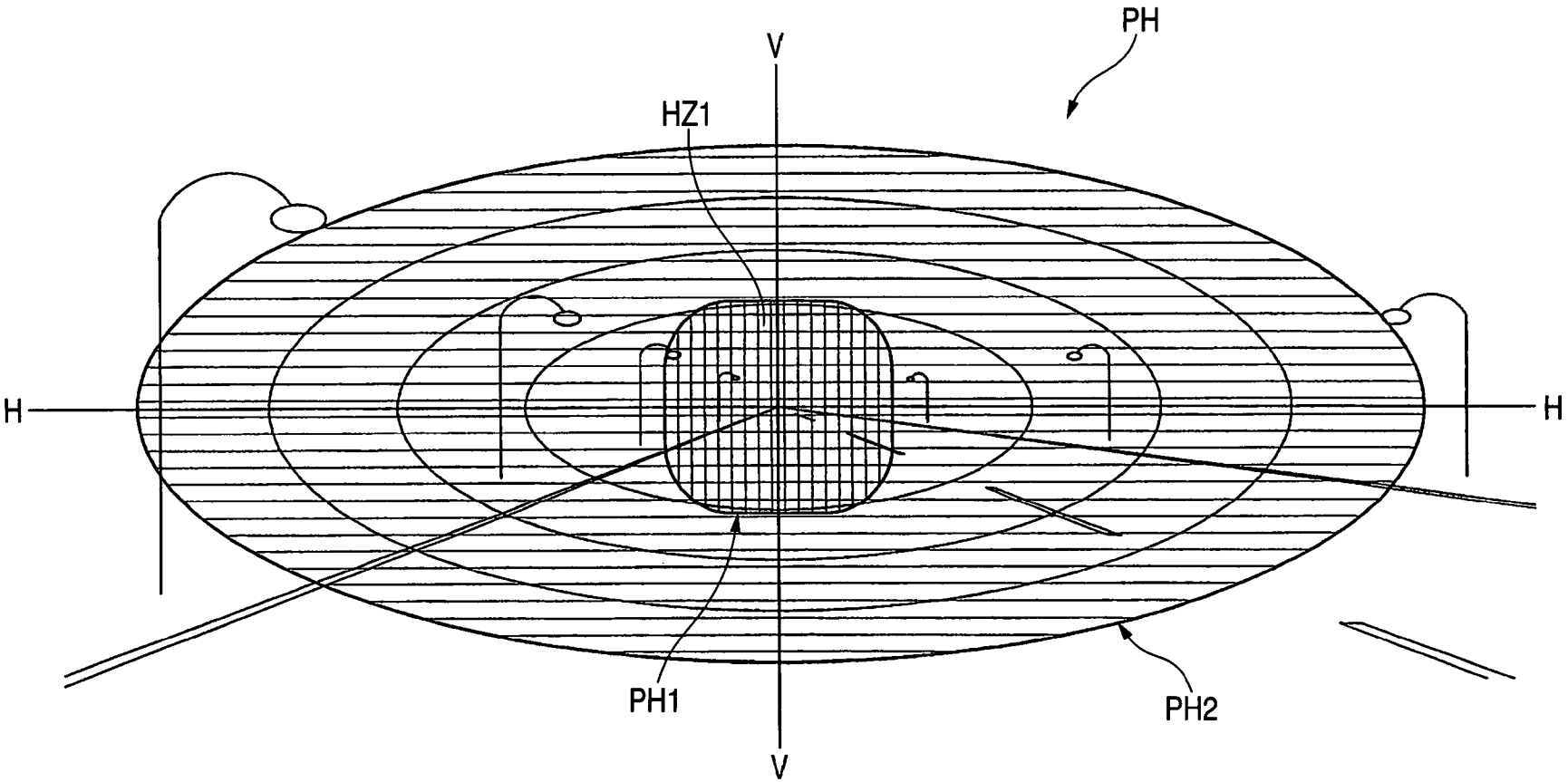
FIG. 5 is a perspective view of a high beam light distribution pattern which is formed by light emitted forward from the vehicle lamp unit on an imaginary vertical screen disposed 25 m ahead of the lamp unit.

FIG. 5 is a perspective view of a high beam light distribution pattern PH which is formed by light emitted forward from the vehicle lamp unit 10 according to the embodiment on an imaginary vertical screen disposed 25 m ahead of the lamp unit.

As shown in the same drawing, this high beam light distribution pattern PH is a transversely elongated light distribution pattern which is largely expanded in the horizontal direction about an H-V point which is a vanishing point in a directly forward direction of the lamp unit and in which a hot zone HZ1, which is a high luminous intensity area, is formed at the position of the H-V point.

The high beam light distribution patter PH is made as a composite light distribution pattern of a primary light distribution pattern PH1 which is formed by direct emitted light from the light transmitting member 14 and a secondary light distribution pattern PH2 which is formed by indirect emitted light from the light transmitting member 14 which is reflected on the reflector 16.

The primary light distribution pattern PH1 is a light distribution pattern formed as an inverted image of the light emitting chip 12*a* of the light emitting element 12 and is formed as a spot-like light distribution pattern having a substantially square external shape at the H-V point.

On the other hand, the secondary light distribution pattern PH2 is formed as a transversely elongated light distribution pattern which is largely expanded in the horizontal direction about the H-V point. While a vertical width of the secondary light distribution pattern PH is made larger than a vertical width of the primary light distribution pattern PH1, this is because, as shown in FIG. 4, the image of the light emitting chip 12*a* which is formed by the indirect emitted light from the light transmitting member 14 which is reflected on the reflector 16 becomes larger than the image of the light emitting chip 12*a* which is formed by the direct emitted light from the light transmitting member 14. Note that in the secondary light distribution pattern PH2, a plurality of curves which are formed substantially concentric with a curve representing a contour thereof are curves of equal luminous intensity, which indicates that the secondary light distribution pattern PH2 gets gradually brighter from an outer circumferential edge to a center thereof.

Thus, since the high beam light distribution pattern PH is made as the composite light distribution pattern made up of the spot-like primary light distribution pattern PH1 and the transversely elongated secondary light distribution pattern PH2 which is largely expanded in the horizontal direction to thereby form the light distribution pattern having the bright hot zone HZ1 at the H-V point, sufficient vision ahead of the vehicle can be ensured while the vehicle is driven with the lights set on high beam.

As has been described in detail, according to the embodiment, in the vehicle lamp unit 10 made to implement light emission for forming the high beam light distribution pattern PH, not only can the light beam utilization ratio to light from the light emitting element 12 thereof be enhanced but also the control of light emitted from the lamp unit 10 can be implemented with good accuracy.

In particular, in the embodiment, since the reflecting surface 16*a* of the reflector 16 has the parabolic vertical sectional shape which adopts the point A constituting the imaginary point source for the indirect emitted light from the light transmitting member 14 as the focal point thereof, the indirect emitted light from the light transmitting member 14 can be reflected forward with almost no light being diffused in the vertical direction, whereby the secondary light distribution pattern PH2 is prevented from unnecessarily expanding vertically to thereby illuminate excessively a near-field area on the road surface ahead of the vehicle.

In addition, in the embodiment, since the frontal surface 14*a* of the light transmitting member 14 is made up of the ellipsoid of revolution which adopts the optical axis Ax as the center axis thereof and the point where the light emitting element 12 is disposed on the optical axis Ax as the rear primary focal point F1 and the eccentricity of the ellipsoid of revolution is set to the inverse of a number of the refraction index "n" of the light transmitting member 14, the direct emitted light from the light transmitting member 14 can be made extremely accurate parallel light, whereby the spot-like primary light distribution pattern PH1 can be reduced to a minimum size. By adopting this construction, the hot zone HZ1 of the high beam light distribution pattern PH can be made to be sufficiently bright.

In addition, in the embodiment, while the position of the boundary between the central region 14*a*1 and the circumferential edge region 14*a*2 on the front surface 14*a* of the light transmitting member 14 has been described as being set at the position where the plane that intersects with the optical axis at right angles intersects with the ellipsoid of revolution slightly rearward of the secondary focal point F2, the boundary may be set at any other positions.

In this case, in the event that the boundary position is displaced to the front side, the direct emitted light from the light transmitting member 14 can be reduced whereas the indirect emitted light from the light transmitting member 14 can be increased. Then, as this occurs, while the brightness of the primary light distribution pattern PH1 is reduced, the brightness of the secondary light distribution pattern PH2 can be increased. On the other hand, in the event that the boundary position is displaced to the rear side, the indirect emitted light from the light transmitting member 14 can be reduced, whereas the direct emitted light from the light transmitting member 14 can be increased. Then, as this occurs, while the brightness of the secondary light distribution pattern PH2 can be reduced, the brightness of the primary light distribution pattern PH1 can be increased.

Next, a second embodiment of the invention will be described below.

Figure 6:
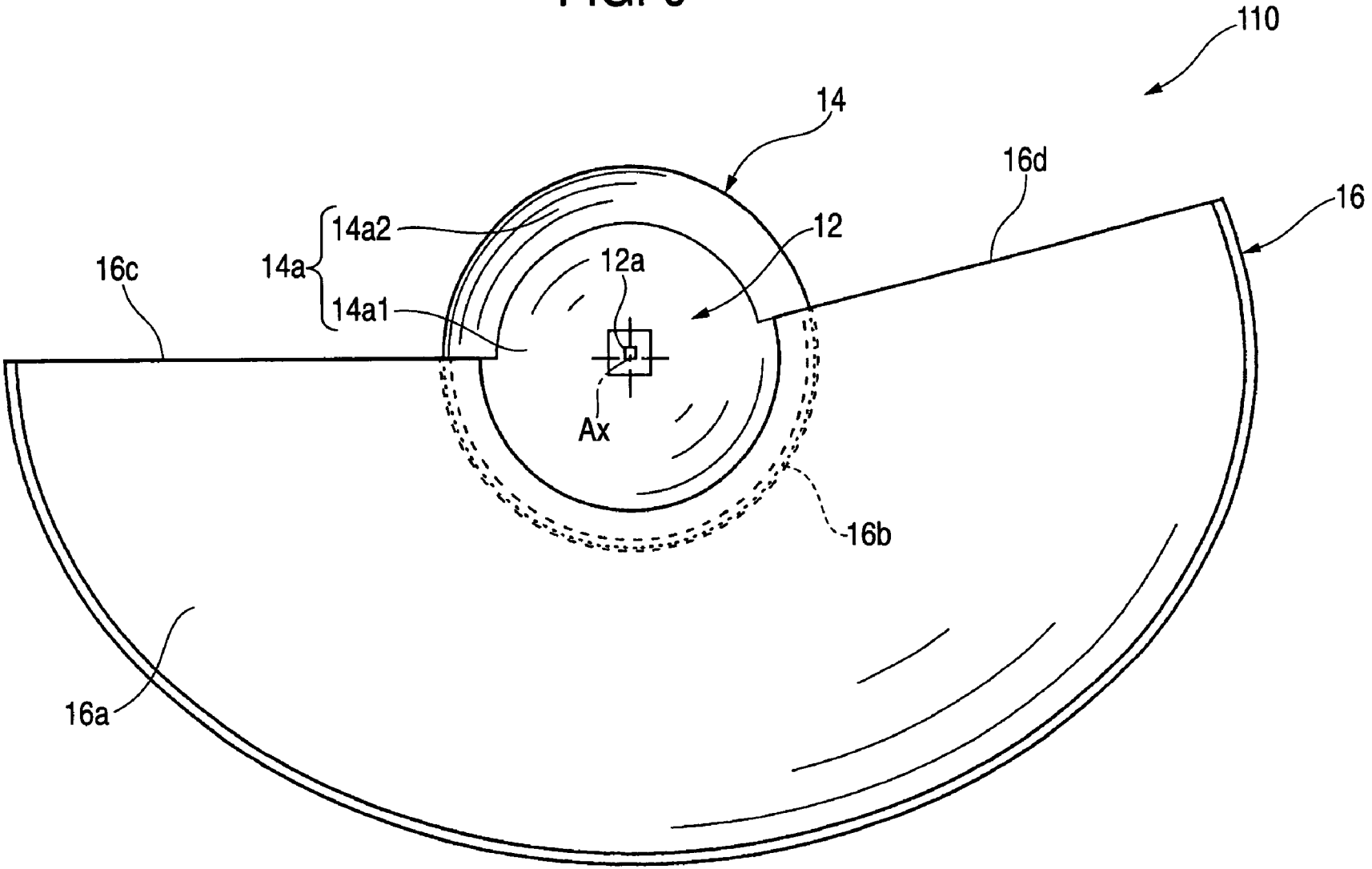
FIG. 6 is a front view showing a vehicle lamp unit according to a second embodiment of the invention.
Figure 7:
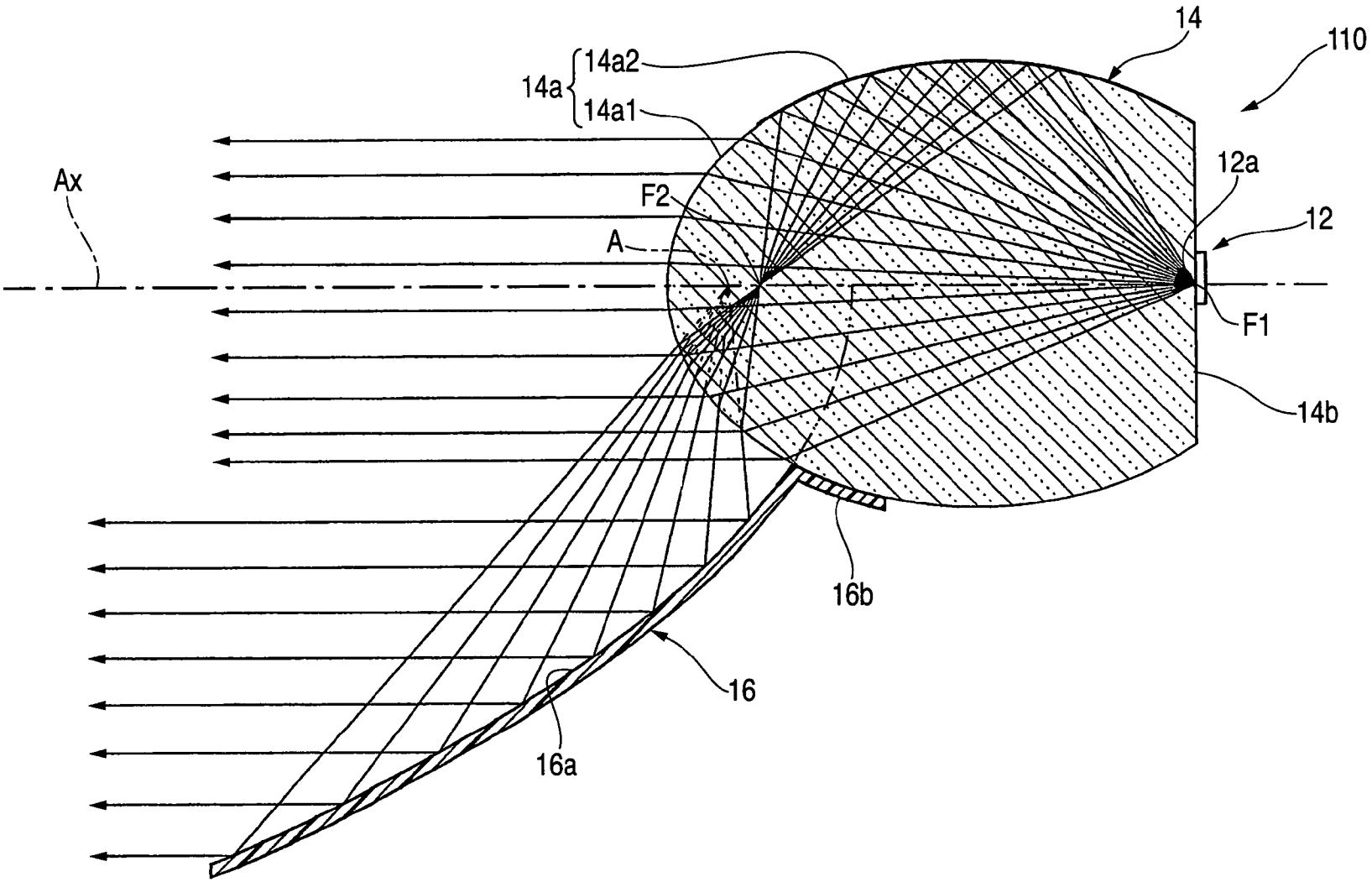
FIG. 7 is a sectional side view of the vehicle lamp unit shown in FIG. 6.

FIG. 6 is a front view of a vehicle lamp unit 110 according to the second embodiment, and FIG. 7 is a sectional side view thereof.

As shown in the drawings, this vehicle lamp unit 110 is also a headlamp and is constructed to emit light for forming a low beam light distribution pattern.

While the basic construction of the vehicle lamp unit 110 is totally similar to the vehicle lamp unit 10 of the first embodiment, the vehicle lamp unit 110 differs from the vehicle lamp unit 10 in the arrangement of a light emitting element 12, the face treatment of a light transmitting member 14 and the construction of a reflector 16.

Namely, in the second embodiment, the light emitting element 12 is disposed at a position displaced slightly upward of the position in the first embodiment. To be specific, the light emitting element 12 is disposed in such a manner that a lower end edge of a light emitting chip 12*a* is positioned on an optical axis Ax.

In addition, in the light transmitting member 14 according to the embodiment, substantially only an upper half portion of a circumferential edge region 14*a*2 on a frontal surface 14*a* thereof is made as a light reflecting surface. To be specific, a range equal to a central angle of 165° formed from a horizontal position on a right-hand side of the optical axis Ax to a position displaced diagonally upwardly through 15° from the optical axis Ax on a left-hand side of the optical axis Ax is formed as a light reflecting surface. In this case, a front end position of the light reflecting surface is set at a position where a plane that intersects with the optical axis Ax at right angles at the secondary focal point F2 intersects with the ellipsoid of revolution.

Furthermore, the reflector 16 of the second embodiment is constructed to surround substantially only a lower half portion of the light transmitting member 14. To be specific, the reflector 16 is formed over a range equal to a central angle of 195° formed from the horizontal position on the right-hand side of the optical axis Ax to the position displaced diagonally upwardly through 15° from the optical axis Ax on the left-hand side of the optical axis Ax. As with the reflecting surface 16*a* of the reflector 16 according to the first embodiment, a reflecting surface 16*a* of the reflector 16 has a parabolic vertical sectional shape which adopts a point A which is positioned forward of and near to the secondary focal point F2 of the ellipsoid of revolution on the optical axis Ax as a focal point thereof, as well as a hyperbolic horizontal sectional shape which adopts the point A as a focal point thereof.

The vehicle lamp unit 110 according to the embodiment is designed to be mounted on the vehicle in a state where the lamp unit 110 is disposed such that the optical axis Ax thereof extends in a direction downward at an angle of on the order of 0.5 to 0.6° relative to the longitudinal direction of the vehicle.

Figure 8:
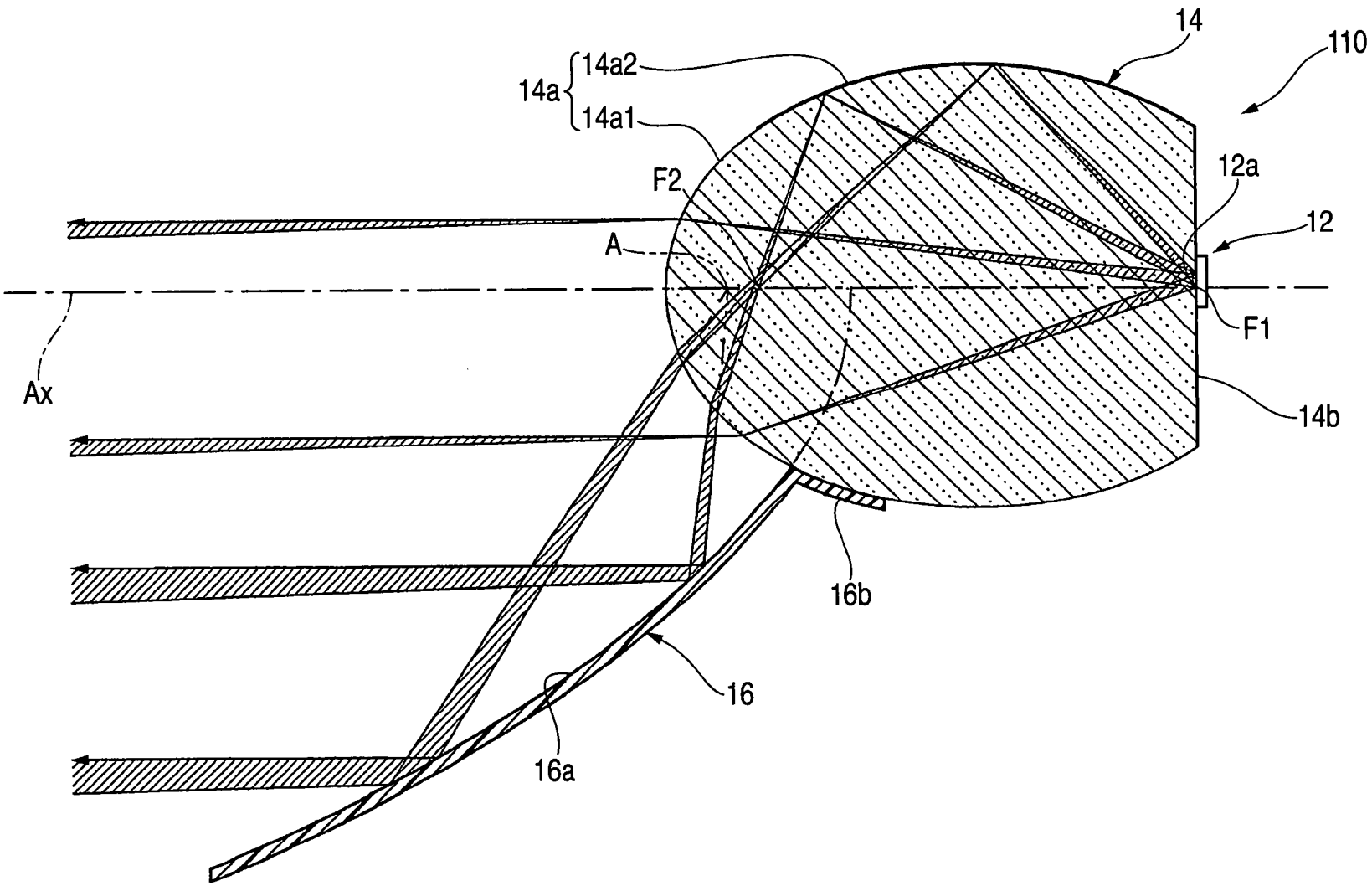
FIG. 8 is a drawing similar to FIG. 7, which illustrates optical paths of light emitted from the vehicle lamp unit shown in FIG. 6 by taking for example light emitted from upper and lower end edges of a light emitting chip of a light emitting element.

FIG. 8 is a drawing similar to FIG. 7, which illustrates optical paths of light emitted from the vehicle lamp unit 110 by taking for example light emitted from upper and lower end edges of the light emitting chip 12*a* of the light emitting element 12.

As shown in the same drawing, on directed emitted light from the light transmitting member 14, directed emitted light from the lower end edge of the light emitting chip 12*a* constitutes parallel light to the optical axis Ax, whereas light from the upper end edge of the light emitting chip 12*a* constitutes light which is directed slightly downward of the parallel light.

On the other hand, of indirect emitted light from the light transmitting member 14 which is reflected on the reflector 16, indirect emitted light from the lower end edge of the light emitting chip 12*a* constitutes parallel light to the optical axis Ax, whereas light from the upper end edge of the light emitting chip 12*a* constitutes light which is directed slightly downward of the parallel light.

Figure 9:
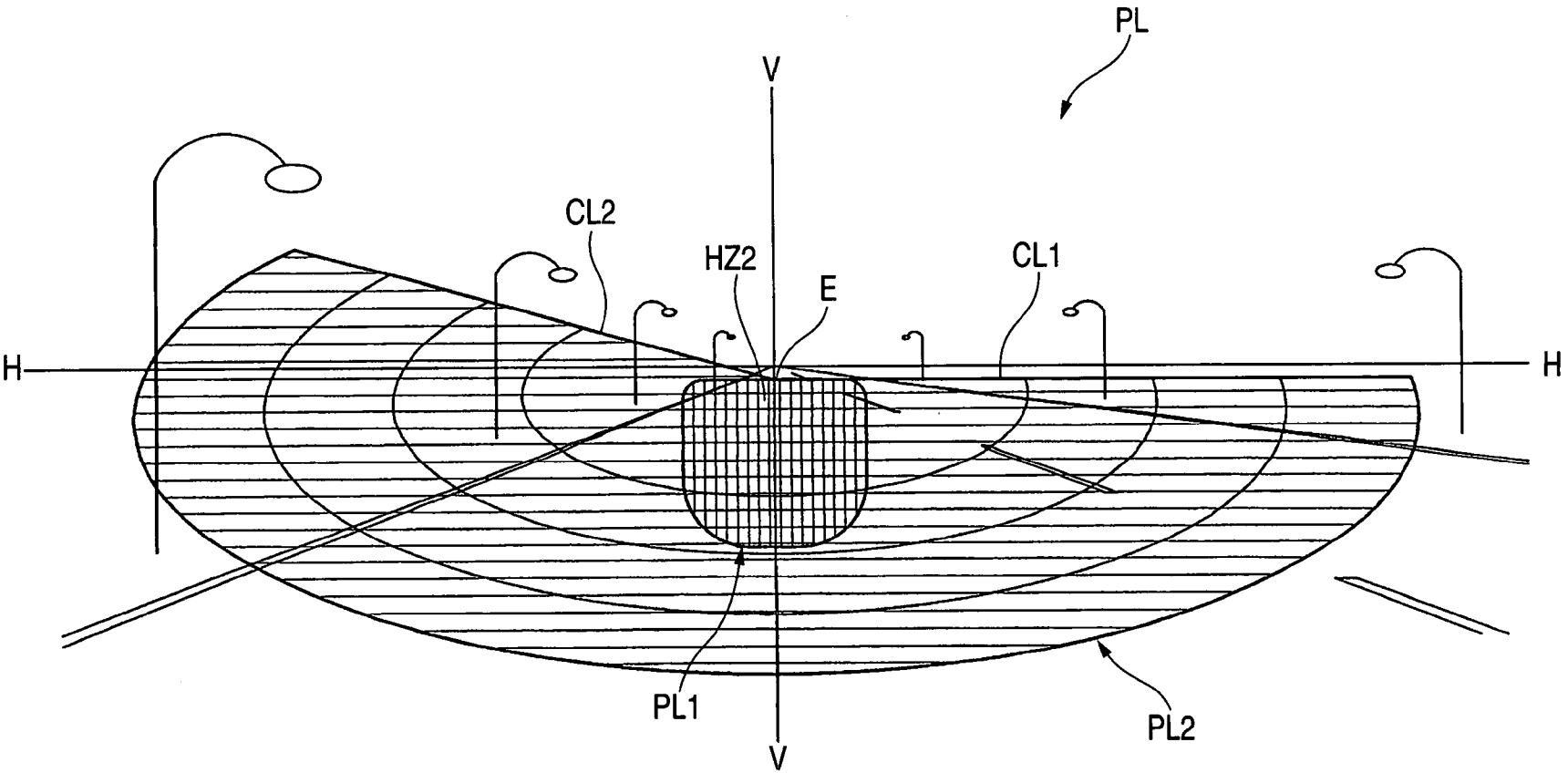
FIG. 9 is a perspective view of a low beam light distribution pattern which is formed by light emitted forward from the vehicle lamp unit shown in FIG. 6 on the imaginary vertical screen.

FIG. 9 is a perspective view of a low beam light distribution pattern PL which is formed by light emitted forward from the vehicle lamp unit 110 according to the embodiment on an imaginary vertical screen disposed 25 m ahead of the same lamp unit.

As shown in the same drawing, this low beam light distribution pattern is a light distribution pattern for the left-hand side traffic and has at an upper end edge thereof a horizontal cut-off line CL1 and a diagonal cut-off line CL2 which rises from the horizontal cut-off line CL1 at an angle of 15°, and the position of an elbow point E, which constitutes a point of intersection between both the cut-off lines CL1, CL2, is set at a position which is displaced downward from an H-V point, which is a vanishing point in a directly forward direction of the lamp unit, at an angle of on the order of 0.5 to 0.6°. Then, in this low beam light distribution pattern PL, a hot zone HZ2 is formed downward of and near to the elbow point E.

This low beam light distribution pattern PL is formed as a composite light distribution pattern of a primary light distribution pattern PL1 which is formed by the direct emitted light from the light transmitting member 14 and a secondary light distribution pattern PL2 which is formed by the indirect emitted light from the light transmitting member 14 which is reflected on the reflector 16.

The primary light distribution pattern PL1 is formed as a spot-like light distribution pattern having a substantially square external shape as an inverted image of the light emitting chip 12*a* of the light emitting element 12. In this case, since the vehicle lamp unit 110 is disposed such that the optical axis Ax thereof extends downward at the angle of on the order of 0.5 to 0.6° relative to the longitudinal direction of the vehicle and the light emitting element 12 is disposed such that the lower end edge of the light emitting chip 12*a* is positioned on the optical axis Ax, the primary light distribution pattern PL1 is such that the upper end edge thereof has a high brightness/darkness ratio.

On the other hand, the secondary light distribution pattern PL2 is made as a transversely elongated light distribution pattern which expands largely in the horizontal direction about a V—V line and which has both the cut-off lines CL1, CL2 along the upper end edge thereof. In this case, the horizontal cut-off line CL1 is formed by a right upper end edge 16*c* of the reflector 16, whereas the diagonal cut-off line CL2 is formed by a left upper end edge 16*d* of the reflector 16.

While a vertical width of the secondary light distribution pattern PL2 is made larger than a vertical width of the primary light distribution pattern PL1, this is because, as shown in FIG. 8, the image of the light emitting chip 12*a* formed by the indirect emitted light from the light transmitting member 14 which is reflected on the reflector 16 becomes larger than the image of the light emitting chip 12*a* formed by the direct emitted light from the light transmitting member 14. Note that in this secondary light distribution pattern PL2, a plurality of curves which are formed substantially concentric with a curve representing a contour thereof are curves of equal luminous intensity, which indicates that the secondary light distribution pattern PL2 gets gradually brighter from an outer circumferential edge to a center thereof.

Thus, since the low beam light distribution pattern PL is made as the composite light distribution pattern made up of the spot-like primary light distribution pattern PL1 and the transversely elongated secondary light distribution pattern PL2 which is largely expanded in the horizontal direction to thereby form the light distribution pattern having the horizontal and diagonal cut-off lines CL1, CL2 and having the bright hot zone HZ2 in the vicinity of the elbow point E, sufficient vision ahead of the vehicle can be ensured while the vehicle is driven with the lights set on low beam.

As has been described in detail, according to the embodiment, in the vehicle lamp unit 110 made to implement light emission for forming the low beam light distribution pattern PL, not only can the light beam utilization ratio to light from the light emitting element 12 thereof be enhanced but also the control of light emitted from the lamp unit 110 can be implemented with good accuracy.

In particular, in the embodiment, since substantially only the upper half portion of the circumferential edge region 14*a*2 on the frontal surface 14*a* of the light transmitting member 14 is made as the light reflecting surface, almost no upward light can be emitted from the vehicle lamp unit 110, whereby the vehicle lamp unit 110 can be made suitable for forming the low beam light distribution pattern PL.

In addition, in the embodiment, since the light emitting element 12 is disposed such that the lower end edge of the light emitting chip 12*a* thereof is positioned on the optical axis Ax, the spot-like primary light distribution pattern PL1 can be made into a light distribution pattern whose upper end edge has a high brightness/darkness ratio along the horizontal cut-off line CL1, whereby the primary light distribution pattern PL1 can be made suitable for forming the low beam light distribution pattern PL.

Furthermore, in the embodiment, since the reflecting surface 16*a* of the reflector 16 has the parabolic vertical sectional shape which adopts the point A constituting the imaginary point source for the indirect emitted light from the light transmitting member 14 as the focal point thereof, the indirect emitted light from the light transmitting member 14 can be reflected forward with almost no light being diffused in the vertical direction, whereby the secondary light distribution pattern PL2 is prevented from unnecessarily expanding vertically to thereby illuminate excessively a near-field area on the road surface ahead of the vehicle.

In addition, in the embodiment, since the frontal surface 14*a* of the light transmitting member 14 is made up of the ellipsoid of revolution which adopts the optical axis Ax as the center axis thereof and the point where the light emitting element 12 is disposed on the optical axis Ax as the rear primary focal point F1 and the eccentricity of the ellipsoid of revolution is set to the inverse of a number of the refraction index n of the light transmitting member 14, the direct emitted light from the light transmitting member 14 can be made extremely accurate parallel light, whereby the spot-like primary light distribution pattern PL1 can be reduced to a minimum size. By adopting this construction, the hot zone HZ2 of the low beam light distribution pattern PL can be made to be sufficiently bright.

In addition, in the embodiment, while the position of the boundary between the central region 14*a*1 and the circumferential edge region 14*a*2 on the front surface 14*a* of the light transmitting member 14 has been described as being set at the position where the plane that intersects with the optical axis at right angles intersects with the ellipsoid of revolution at the secondary focal point F2, the boundary may be set at any other positions.

In this case, in the event that the boundary position is displaced to the front side, the direct emitted light from the light transmitting member 14 can be reduced whereas the indirect emitted light from the light transmitting member 14 can be increased. Then, as this occurs, while the brightness of the primary light distribution pattern PL1 is reduced, the brightness of the secondary light distribution pattern PL2 can be increased. On the other hand, in the event that the boundary position is displaced to the rear side, the indirect emitted light from the light transmitting member 14 can be reduced, whereas the direct emitted light from the light transmitting member 14 can be increased. Then, as this occurs, while the brightness of the secondary light distribution pattern PL2 can be reduced, the brightness of the primary light distribution pattern PL1 can be increased.

In the respective embodiments, while the light emitting chip 12*a* of the light emitting element 12 has been described as being formed as the square whose perimeter is 0.3 to 3 mm, light emitting chips formed into any other external shapes (for example, a transversely elongated rectangular shape or the like) can be used.

In the respective embodiments, as to the parabola constituting the vertical sectional shape of the reflecting surface 16*a* of the reflector 16, in the event that the focal length thereof is changed, the sizes of the secondary light distribution patterns PH2, PL2 can be changed in association therewith, whereby the ratio of size between the primary light distribution pattern PH1, PL1 and the secondary light distribution pattern PH2, PL2 can be changed appropriately.

In the event that vehicle headlamps are made up of the vehicle lamp units 10, 110 of the respective embodiments, a plurality of vehicle lamp units 10, 110 according to the respective embodiments may be used or the vehicle lamp units may be combined with other vehicle lamp units appropriately depending on quantities of light required to be emitted.

It will be apparent to those skilled in the art that various modifications and variations can be made to the described preferred embodiments of the present invention without departing from the spirit or scope of the invention. Thus, it is intended that the present invention cover all modifications and variations of this invention consistent with the scope of the appended claims and their equivalents.

What is claimed is:

1. A vehicle lamp unit comprising:

a light emitting element disposed near or on an optical axis extending in a longitudinal direction of the lamp unit so as to be directed forward;

a light transmitting member covering the light emitting element from a front side of the light emitting element, wherein a frontal surface of the light transmitting member comprises an ellipsoid of revolution having a center axis on the optical axis and a rear primary focal point at a point near the light emitting element on the optical axis, the light transmitting member comprises a light emitting surface on a central region on the frontal surface positioned near the optical axis and a light reflecting surface on a circumferential edge region on the frontal surface positioned outer circumferentially of the central region, the light emitting surface emits light from the light emitting element forward, and the light reflecting surface internally reflects the light from the light emitting element so as to be directed towards a secondary focal point of the ellipsoid of revolution; and a reflector that is provided on a perimeter of the light transmitting member and reflects forward the light from the light emitting element which is internally reflected on the light reflecting surface on the circumferential edge region and is then emitted from the light emitting surface on the central region.

2. The vehicle lamp unit according to claim 1, wherein the light emitting element comprises a light emitting diode including a light emitting chip and a resin sealing member that seals the light emitting chip, and the resin sealing member is integrally formed with the light transmitting member.

3. The vehicle lamp according to claim 2, wherein a lower end edge of the light emitting chip is positioned on the optical axis.

4. The vehicle lamp unit according to claim 1, wherein a reflecting surface of the reflector comprises a substantially parabolic vertical sectional shape having a focal point at a point on the optical axis positioned forward of and near to the secondary focal point of the ellipsoid of revolution.

5. The vehicle lamp unit according to claim 1, wherein the reflector surrounds substantially only a lower half portion of the light transmitting member, and the light reflecting surface is provided on substantially only an upper half portion of the circumferential edge region on the frontal surface of the light transmitting member.

6. The vehicle lamp unit according to claim 1, wherein the light reflecting surface is formed on the light transmitting member.

7. The vehicle lamp unit according to claim 6, wherein the light reflecting surface is formed on the light transmitting member by applying a mirror treatment.

8. The vehicle lamp unit according to claim 7, wherein the mirror treatment is a deposition of aluminum.

* * * * *